US006216770B1

(12) United States Patent
Hensger et al.

(10) Patent No.: US 6,216,770 B1
(45) Date of Patent: Apr. 17, 2001

(54) METHOD OF IMPROVING THE SURFACE QUALITY OF A CONTINUOUSLY CAST SLAB

(75) Inventors: Karl-Ernst Hensger, Düsseldorf; Manfred Kolakowski, Erkrath; Ingo Schuster, Meerbusch, all of (DE); David J. Rintoul, Orland Park, IL (US)

(73) Assignees: SMS Schloemann-Siemag Aktiengesellschaft, Düsseldorf (DE); ACME Metals Incorporated, Riverdale, IL (US)

( * ) Notice: Subject to any disclaimer, the term of this patent is extended or adjusted under 35 U.S.C. 154(b) by 0 days.

(21) Appl. No.: 09/187,270

(22) Filed: Nov. 6, 1998

(30) Foreign Application Priority Data

Nov. 17, 1997 (DE) ..... 197 50 817

(51) Int. Cl.[7] ..... B21C 43/00
(52) U.S. Cl. ..... 164/476; 29/81.01; 72/39
(58) Field of Search ..... 164/476; 29/81.01, 29/81.03, 81.06; 72/39, 40

(56) References Cited

U.S. PATENT DOCUMENTS 5,131,126 * 7/1992 Katsuki et al. ..... 29/81.01
5,964,275 * 10/1999 Flick et al. ..... 164/476

FOREIGN PATENT DOCUMENTS 53-5031 * 1/1978 (JP) ..... 72/39
54-58630 * 5/1979 (JP) ..... 72/39
56-9001 * 1/1981 (JP) .
57-70019 * 4/1982 (JP) ..... 72/39
59-28578 * 2/1984 (JP) ..... 72/39
5-17888 * 1/1993 (JP) ..... 72/39
5-25666 * 2/1993 (JP) ..... 29/81.06

* cited by examiner

*Primary Examiner*—Kuang Y. Lin
(74) *Attorney, Agent, or Firm*—Friedrich Kueffner

(57) ABSTRACT

A method of improving the surface quality of a continuously cast slab, particularly a thin slab having a maximum cast thickness of 100 mm, wherein the slab is covered with a casting slag film and a layer of scale, and wherein the slab is descaled after casting and is rolled in a finishing train. A reaction agent, which is different from water, is applied onto the slab prior to descaling or during descaling. The application of the reaction agent may be preceded by a conventional hydraulic, mechanical or pneumatic removal of the layer of scale which covers the slab.

10 Claims, 1 Drawing Sheet

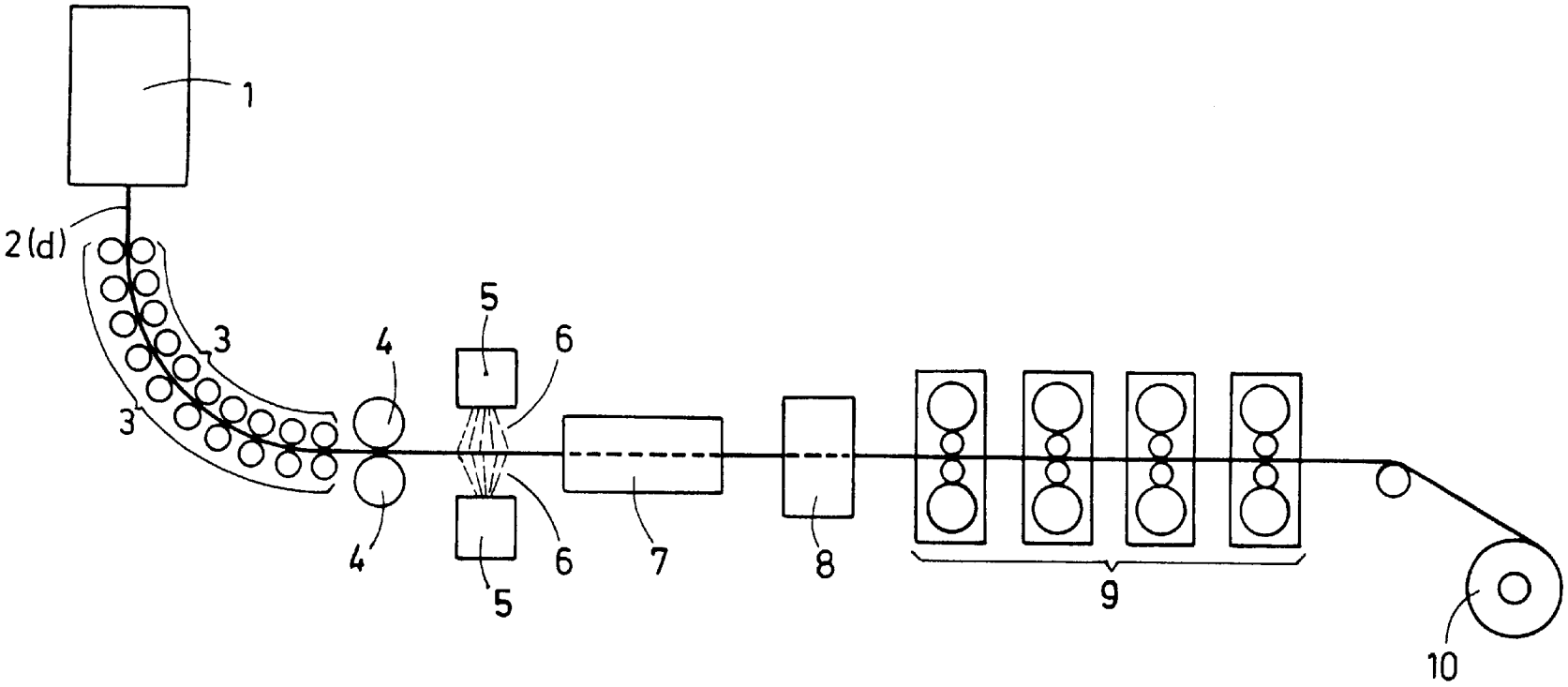
1
2(d)
3
3
4
4
5
5
6
6
7
8
9
10

METHOD OF IMPROVING THE SURFACE QUALITY OF A CONTINUOUSLY CAST SLAB

BACKGROUND OF THE INVENTION

1. Field of the Invention

The present invention relates to a method of improving the surface quality of a continuously cast slab, particularly a thin slab having a maximum cast thickness of 100 mm, wherein the slab is covered with a casting slag film and a layer of scale, and wherein the slab is descaled after casting and is rolled in a finishing train.

2. Description of the Related Art

After rolling thin slabs in a finishing train, the rolled hot strip very frequently has stripes or streaks on its surface. In many types of later applications of the hot strips, these stripes can be tolerated. However, when the quality requirements are particularly high, these stripes or streaks cannot be tolerated. Therefore, in these types of applications, thick slabs having a cast thickness of at least 150 mm are still being used. However, this is comparatively expensive and cumbersome.

SUMMARY OF THE INVENTION

Therefore, it is the primary object of the present invention to provide a method of improving the surface quality of the continuously cast slab in which stripes and streaks no longer occur on the surface or are at least significantly reduced, so that thin slabs can also be used as the initial material for applications with high quality requirements.

In accordance with the present invention, a reaction agent, which is different from water, is applied onto the slab prior to descaling or during descaling.

The application of the reaction agent may be preceded by a conventional hydraulic, mechanical or pneumatic removal of the layer of scale which covers the slab.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

The single FIGURE of the drawing schematically shows a thin slab casting plant followed by a finishing train.

DESCRIPTION OF THE PREFERRED EMBODIMENTS

In a thin slab casting plant 1 illustrated in the drawing, a slab 2 having a cast thickness d is being cast. The cast thickness d is between 20 and 100 mm, for example, 50 mm.

After casting, the slab 2 is bent by the guide rollers 3 from the vertical direction into the horizontal direction. Subsequently, the slab 2 is rough-rolled by roughing rolls 4, for example, from 50 mm to 35 mm. The rough-rolling step preferably takes place prior to or immediately following the complete solidification of the slab 2.

In order to ensure that the molten metal to be cast in the thin slab casting plant 1 does not adhere to the plant 1, a casting powder is used in the thin slab casting plant, wherein the casting powder ends up as a layer of slag between the mold wall and the strand shell. At the high casting temperatures, the casting slag combines with the surface of the slab 2 to be cast, so that it forms a slag film on the surface of the slab 2. Moreover, when the slab 2 leaves the thin slab casting plant 1, it is still so hot that when ambient oxygen is added, an oxide layer, i.e., a layer of scale, is immediately formed on the slab 2. These two layers, i.e., the slag film and the layer of scale, must be removed as completely as possible prior to rolling.

For this purpose, a reaction agent 6 which is emulsified in water glass is sprayed onto the slab 2 from nozzles 5. Subsequently, the slab is heated in a tunnel furnace 7 for about 20–30 minutes and is then descaled in the descaler 8. After descaling, the slab 2 is rolled in a multiple-stand finishing train 9 and is coiled onto a reel 10. In the illustrated embodiment, the finishing train 9 has four stands. Of course, the finishing train may have more or fewer than four stands, for example, six or two stands.

By applying the reaction agent 6, the layer of scale and the slag film have a significantly better solubility than without the reaction agent 6. As a result, the two layers are almost completely removed during descaling, so that virtually no stripes and streaks still remain on the rolled strip after rolling. The heating of the slab 2 serves to melt the areas of the slab 2 near the surface thereof, i.e., heating constitutes a thermal treatment of the slab 2. The slab 2 is descaled conventionally in the descaler 8, for example, hydraulically, pneumatically and/or mechanically.

A variety of substances can be used as the reaction agent 6. For example, metal powders can be used which contain at least one of the following metals: Si, Al, CaSi or CaAl. Non-metals, such as carbon, can also be used. Also used can be oxides, for example, CaO, $SiO_2$, $Al_2O_3$, MgO, MnO, $Na_2O$, FeO, $Fe_2O_3$ or $Fe_3O_4$.

The reaction agent 6 is present in the carrier substance in a concentration of up to 90% by volume. About 1 to 2 liters of the undiluted reaction agent 6 are required for each square meter of strip surface to be treated.

Finally, is should be mentioned that the reaction agent 6 does not absolutely have to be applied to the strip 2 before the tunnel furnace 7. The reaction agent 6 could also be applied, for example, only in the tunnel furnace 7 or during the descaling procedure itself.

While specific embodiments of the invention have been shown and described in detail to illustrate the inventive principles, it will be understood that the invention may be embodied otherwise without departing from such principles.

We claim:

1. A method of improving the surface quality of a continuously cast slab, wherein the slab is covered by a casting slag film and a layer of scale, the method comprising descaling the slab after casting and rolling the slab in a finishing train, further comprising applying a metal powder onto the slab prior to descaling or during descaling.

2. The method according to claim 1, wherein the metal is Si, Al, CaSi or CaAl.

3. The method according to claim 1, wherein the continuously cast slab is a thin slab having a maximum cast thickness of 100 mm.

4. The method according to claim 1, further comprising, after applying the metal powder, subjecting the slab to a thermal treatment.

5. The method according to claim 4, wherein the thermal treatment comprises heating the slab for a short period of time for melting portions of the slab near the surface thereof.

6. The method according to claim 1, comprising rough-rolling the slab prior to applying the metal powder and prior to descaling.

7. The method according to claim 6, comprising rough-rolling the slab prior to or immediately following a complete solidification of the slab.

8. The method according to claim 1, comprising carrying out descaling at least one of hydraulically, pneumatically and mechanically.

9. The method according to claim 1, wherein the metal powder is mixed with a carrier substance.

10. The method according to claim 9, wherein the carrier substance is water or water glass.

* * * * *